United States Patent [19]

d'Orgelys

[11] 4,150,760

[45] Apr. 24, 1979

[54] CHILDPROOF ENCLOSURE

[76] Inventor: Henri Y. d'Orgelys, 3936 San Clerc Rd., Jacksonville, Fla. 32217

[21] Appl. No.: 934,693

[22] Filed: Aug. 18, 1978

[51] Int. Cl.[2] ..... B65D 51/12

[52] U.S. Cl. ..... 215/213; 220/251; 220/323; 206/1.5

[58] Field of Search ..... 220/243, 246, 249, 250, 220/251, 323; 215/213; 206/1.5

[56] References Cited

U.S. PATENT DOCUMENTS

| | | | |
|---|---|---|---|
| 1,728,945 | 9/1929 | Porter | 220/323 X |
| 2,206,664 | 7/1940 | Davis | 220/251 X |
| 3,181,718 | 5/1965 | Chancellor | 215/213 |

*Primary Examiner*—George T. Hall

*Attorney, Agent, or Firm*—Clarence A. O'Brien; Harvey B. Jacobson

[57] ABSTRACT

The enclosure comprises a base having perimetric side walls and a cap having coaxial perimetric side walls. The cap and the base have a major axis and a minor axis. A longitudinally extending locking bar is rotatably mounted in the center of the cap and has a length slightly greater than the minor axis of the base. The cap and base have coextensive slots formed in opposing walls which slots start at points on opposite ends of the minor axis and extend in the same direction peripherally about the cap and base for approximately 45°. The portions of the slots on the opposite ends of the minor axis have a thickness which is approximately twice the thickness of the locking bar. The remainder of the slot has a thickness which is approximately equal to the thickness of the locking bar. In this manner, when the locking bar is rotated into the slot, it will proceed through the single thickness area and be biased into the double thickness area where it will be held against further rotation. This produces a tight locked enclosure wherein the manner of reopening is not readily apparent.

8 Claims, 5 Drawing Figures

CHILDPROOF ENCLOSURE

BACKGROUND OF THE INVENTION

1. Field of the Invention

This invention relates to container enclosures which provide a locking device which may be easily opened by adults, but is secure against intrusion by small children in that the manner of reopening the device is not readily apparent.

2. Description of the Prior Art

In recent years, due to Federal regulations, it has become standard practice to enclose drugs, medicines, and other dangerous substances, in child-proof enclosures. This, of course, is to insure that children who inadvertently obtain possession of such enclosures will not quickly open and consume any of the contents. Numerous such child-proof enclosures have been developed. These normally include complicated devices having spring loaded ratchet-type tops or double caps wherein one cap has no extension connected thereto for providing a point of application of force for removal of the cap and the second cap has an extension which fits into an aperture of the first cap in order to apply leverage thereto and effect removal of the first cap. Such devices prove costly and even difficult for an experienced adult to manipulate. Therefore, there remains a need for a simple, safe, and effective enclosure wherein the opening procedure of the enclosure would be readily apparent to an adult but would be quite difficult for a child to ascertain.

SUMMARY OF THE INVENTION

An object of the present invention is to provide a simple, safe and effective enclosure, the opening of which is readily apparent to an adult while obscure to the mind of a child.

A further object of the present invention is to provide an enclosure wherein there are two complete elements, namely, a cap with locking bar and a base. This configuration then eliminates the possibility of loss of one element inherent in an enclosure which contains a plurality of individual components.

A goal of the present invention is to provide an enclosure which requires very little strength to open. The child-proof aspect of the enclosure resides in the sequence of movements necessary in order to release the locking mechanism of the enclosure.

In keeping with the goals and objects of the invention as set forth above, a base is provided having a major and a minor axis. A cap having a similar major and a minor axis is provided to fit within the base with the walls of the cap fitted snugly within the walls of the base forming a coaxial relationship therewith. Attached to the center of the cap is a standard which rotatably mounts a locking bar. The locking bar has a longitudinal dimension greater than the minor axis of the base but less than the major axis of the cap so as to allow a certain amount of pivotal motion of the locking bar within the walls of the cap. Slots are provided in the cap and base beginning on opposite sides of the minor axis. The slots of the cap and base are coextensive and have a thickness at the opposite ends of the minor axis which is twice that of the locking bar. The slots extend peripherally about the cap in like directions starting from the opposite ends of the minor axis at least to a point at which the locking bar may be rotated into contact with the walls of the cap. The thickness of this extent of the slot is approximately equal to that of the locking bar. The locking bar may be biased downwardly to fit within the slot and rotated therein until the locking bar is positioned along the minor axis at which time the ends of the bar will spring upwardly into the second thickness of the slot provided therefor. In this manner it would be necessary to bias the bar downward in order to allow movement within the slot which would disengage the locking bar from the cap nd base. This movement, of course, would be obvious to an adult mind and could be effected with very little effort. To a child, however, the movement is conceptionally difficult to comprehend and thus inhibits the child from opening the enclosure.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
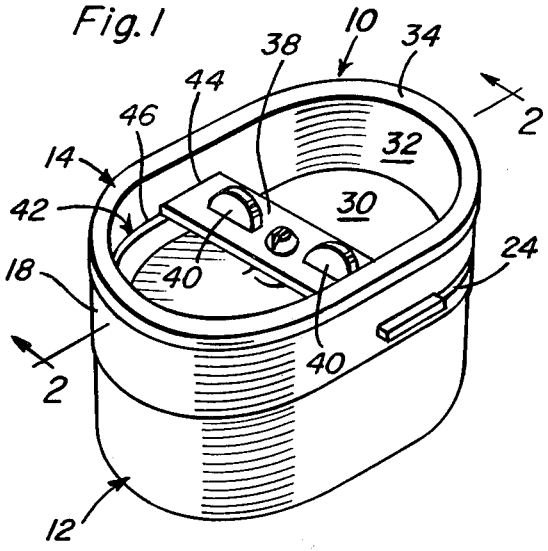
FIG. 1 is a perspective view of the enclosure.

Now with reference to the drawing, the child-proof enclosure of the present invention will be clearly set forth wherein it will be seen that the enclosure device is generally referred to by the numeral 10. The child-proof enclosure comprises a base 12 and a cap 14. It will be noted that the base and cap have a similar shape. Specifically, they are configured to have a generally oval appearance. However, it should be noted that any shape having a major axis and a minor axis would suffice and, more generally, any configuration having a longitudinal dimension greater than a lateral dimension would suffice as will be understood by the explanation to be given.

The base 12 has a generally oval bottom portion 16 which has an open interior for the containment of medicines, pills of any sort, or any other substance which might be hazardous to children. The upper portion 18 of base 12 has a similar shape to the lower portion and is coaxial therewith. The upper portion, however, is slightly larger than the lower portion thereby forming a shoulder 20 upon which the cap 14 may rest. Also, a gasket 22 may be disposed upon shoulder 20 in order to provide a more secure seal between the cap and the base. Upper portion 18 of base 12 also contains a pair of slots 24, which slots have enlarged openings 26 on opposite sides of the minor axis of the base. Smaller slot extensions 28 extend from openings 26 in the same counterclockwise direction about the base upper portion 18.

Cap 14 includes a planar sealing member 30 which rests upon gaskets 22 and shoulder 20 to seal the bottom portion of base 12. The cap also has perimetric wall 32 which fits snugly within and is coaxial with upper portion 18 of the base. An angled flange 34 extends about the upper edge of wall 32 and encompasses the upper edge of upper portion 18 of the base 12. This flange insures proper sealing and seating of the cap on the base. Located in the center of sealing member 30 is a standard 36 which mounts locking bar 38. Standard 36 has a split conical upper section for accepting and holding locking bar 38 thereon. Locking bar 38 has a length greater than the minor axis of base upper portion 18 but less than the major axis of cap 14. Thus it will be seen that locking bar 38 is allowed freedom of rotation about standard 36 within the confines of perimetric wall 32 as shown in phantom position 38' of FIG. 3. It will be noted that locking bar 38 also has upstanding tabs 40 to allow a grasping position for the rotation of the bar.

Perimetric wall 32 contains two slots 42 similar in shape to slots 24 and coextensive therewith when cap 14 is in place on base 12. Slots 42 have enlarged openings 44 which are positioned at opposite ends of the minor axis of the cap and smaller extended openings 48 which run along the periphery of the cap in like directions. The enlarged openings 44 and 26 have a vertical dimension equal to about twice the thickness of locking bar 38 while the smaller extended openings 46 and 28 have a vertical dimension equal to the thickness of locking bar 38. The length of enlarged openings 26 and 46 is approximately equal to the width of the locking bar 38. As mentioned, the slots 24 and 42 are provided in coextensive pairs with the extended openings 28 and 46 ending at a point slightly beyond the point of contact of locking bar 38 with the perimetric wall 32.

Figure 3:
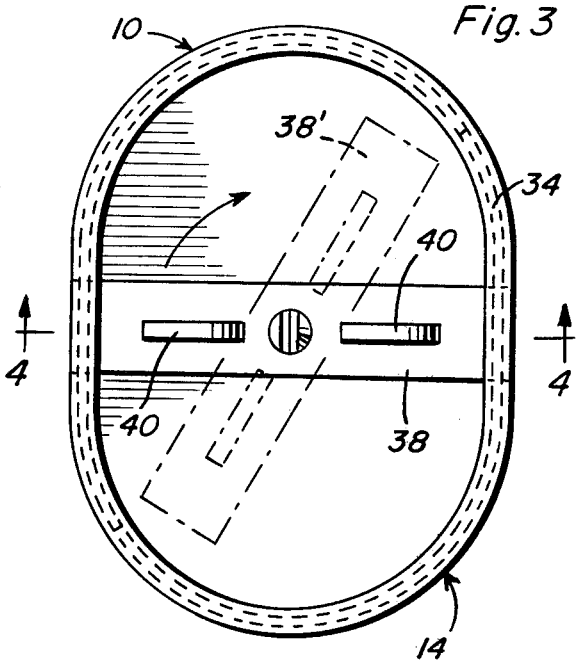
FIG. 3 is a plan view of the enclosure.
Figure 2:
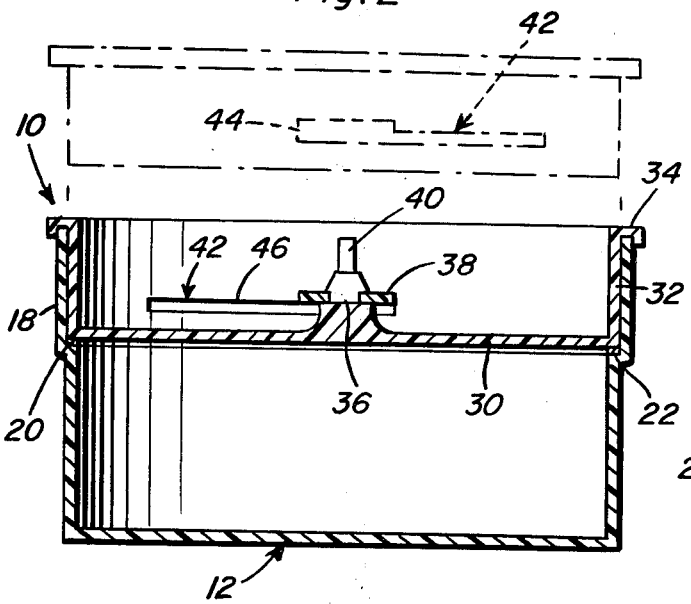
FIG. 2 is a sectional view taken substantially along a plane passing through section line 2—2 of FIG. 1, with an elevational view of the enclosure cap shown in phantom.
Figure 4:
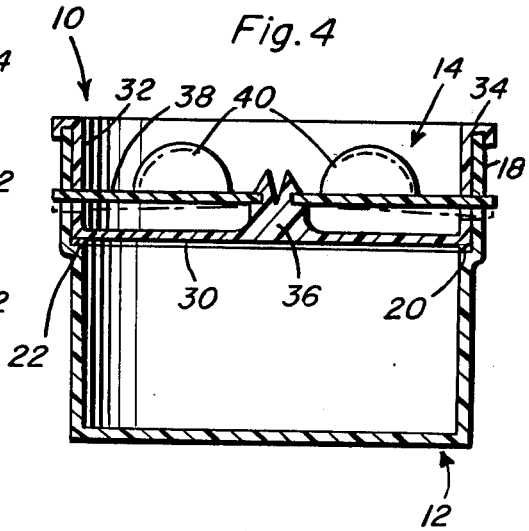
FIG. 4 is a sectional view taken substantially along a plane passing through section line 4—4 of FIG. 3.
Figure 5:
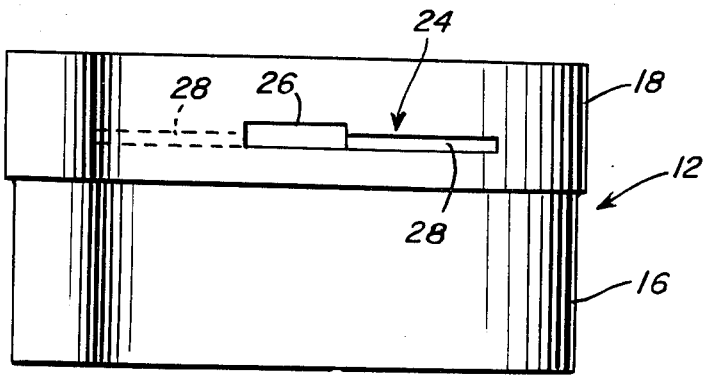
FIG. 5 is an elevational view of the enclosure base.

The height of locking bar 38 when mounted upon standard 36 is such that the locking bar must be biased downwardly in order to engage coextensive slots 24 and 42. When engaging these slots, the locking bar may be rotated in a clockwise direction as seen in FIG. 3 until contact of the bar is made with enlarged areas 26 and 44, whereupon the biased locking bar will spring upwardly into these openings. With the locking bar in this position, it will be impossible to remove the cap 14 from base 12 without providing a downward force upon the locking bar and twisting it in a counterclockwise direction.

The base, cap and locking bar may be made of any suitable material such as plastic or metal and may be formed by a molding operation, if desired. The base may be of unitary construction, while the cap and locking bar may each be unitary also. It will be noted that the device may be configured in any manner so as to allow proper pivotal movement of a locking bar mounted upon a cap. Also, the slots may be positioned so that counterclockwise rotation of the locking bar would lock the device and clockwise rotation would unlock the device.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An enclosure for preventing access to the interior thereof by small children while readily allowing such access by adults comprising: a base having a longitudinal dimension and a lateral dimension with the longitudinal dimension being greater than the lateral dimension, a perimetric wall with at least one circumferentially extending slot in said wall, the slot having one area of greater thickness than the remainder of the slot; a cap for acceptance into said base, the cap having a locking means comprising a longitudinally extending locking bar rotatably mounted on the cap, said locking bar being insertable into said slot upon rotation thereof and being biased into said area of greater thickness upon contact therewith such that rotation of said locking bar is inhibited due to the contact with the enlarged area.

2. The enclosure of claim 1 wherein said cap includes a perimetric wall coaxial with said base perimetric wall and a cap slot, a portion of which is coextensive with a portion of said base slot.

3. The enclosure of claim 1 wherein said base contains a second circumferentially extending slot which is laterally opposed to the first mentioned slot with said locking bar being insertable into said second slot also.

4. The enclosure of claim 3 wherein said cap includes a second slot, at least a portion of which is coextensive with a portion of said base second slot, said locking bar being insertable in the cap second slot also.

5. The enclosure of claim 4 wherein said locking bar has at least one upstanding tab member for allowing a position for the application of the force to rotate the locking bar.

6. The enclosure of claim 2 wherein said cap perimetric wall includes an outwardly extending flange for surmountingly engaging the base perimetric wall when the cap is accepted in the base.

7. The enclosure of claim 6 wherein said base additionally includes a shoulder portion upon which the cap rests when accepted in the base.

8. The enclosure of claim 1 wherein said area of greater thickness has a dimension approximately equal to twice the thickness of the locking bar while the remainder of the slot has a thickness slightly greater than the thickness of the locking bar.

* * * * *